US005664513A

United States Patent [19]

Echelbarger

[11] Patent Number: 5,664,513

[45] Date of Patent: Sep. 9, 1997

[54] FLOATING DRY DOCK

[76] Inventor: Larry R. Echelbarger, 17003 W. Shore Rd., Stanwood, Wash. 98292-7959

[21] Appl. No.: 682,420

[22] Filed: Jul. 17, 1996

[51] Int. Cl.[6] ..... B63C 1/02

[52] U.S. Cl. ..... 114/45; 114/263

[58] Field of Search ..... 114/45, 48, 61, 114/263, 266, 267, 283; 405/4, 7, 218–221

[56] References Cited

U.S. PATENT DOCUMENTS

| | | | |
|---|---|---|---|
| 3,045,263 | 7/1962 | Blachly | 114/352 |
| 3,126,855 | 3/1964 | Freeburg . | |
| 3,224,019 | 12/1965 | Gudmundson . | |
| 3,265,024 | 8/1966 | Kramlich | 114/45 |
| 3,279,141 | 10/1966 | Schmidt | 405/218 |
| 3,289,621 | 12/1966 | Sebring | 114/266 |
| 4,072,119 | 2/1978 | Williams . | |
| 4,655,156 | 4/1987 | Svirklys et al. | 114/266 |
| 5,099,778 | 3/1992 | Palen . | |
| 5,131,342 | 7/1992 | Sackett . | |
| 5,240,347 | 8/1993 | Williams et al. . | |
| 5,380,143 | 1/1995 | Mohan . | |

FOREIGN PATENT DOCUMENTS

| | | |
|---|---|---|
| 60-12392 | 1/1985 | Japan . |
| 63-137096 | 6/1988 | Japan . |

*Primary Examiner*—Edwin L. Swinehart
*Attorney, Agent, or Firm*—Richard C. Litman

[57] ABSTRACT

A floating dry dock for boats. The dry dock has two side pontoons and a front pontoon. Each pontoon has one or more plastic tubs filled with styrofoam batts and attached to the frame for flotation. The top of the pontoons are provided with 2 inch by 6 inch by 27 inch cedar wood decking. The two side pontoons are attached to each other using at least two metal cradles, that also support a boat lift. The outside posts of the front and rear cradles have wheels mounted thereon to allow the dock to be moved from one location to another, over dry land. By varying the length of the pontoons, (and number of cradles), and the number of plastic floatation tubs, the dock can be built and/or adjusted to be used with personal water craft lifts, (2,500 lb capacity), to large boat lifts, (6,800 lb capacity). The adjustable nature of the dry dock makes it usable with a large number of boat lifts.

16 Claims, 4 Drawing Sheets

FLOATING DRY DOCK

BACKGROUND OF THE INVENTION

1. Field of the Invention

The present invention relates to a floating dry dock for boats.

2. Description of the Prior Art

Floating dry docks for boats are known. Unlike non-floating dry docks, floating versions can be used where the water is too deep for standard boat lifts. Additionally, in areas having peat in the water, the mechanisms of boat lifts mounted on the bottom can become fouled. Floating dry docks are used both in fresh water as well as salt water.

U.S. Pat. No. 3,126,855, (Freeburg), discloses a combination floating dry dock and boat trailer. U.S. Pat. No. 3,224,019, (Gudmundson), discloses a floating boat trailer. U.S. Pat. No. 4,072,119, (Williams), discloses a floating dry dock that can lift a boat out of the water by pumping air into two pontoons. U.S. Pat. No. 5,099,778, (Palen), discloses a boat lift that can be secured to a float. U.S. Pat. No. 5,131,342, (Sackett), discloses a floating boat lift that can be pulled like a trailer. U.S. Pat. No. 5,240,347, (Williams et al.), discloses a collapsible boat lift that is operated by a manual wheel. Note that the Williams et al. Patent discloses one type of boat lift that can be mounted on the floating dry dock of the present invention, and this patent is hereby incorporated by reference. U.S. Pat. No. 5,380,143, (Mohan), discloses a combination boat lift and trailer. Japanese patent 60-12392 discloses a floating boat lift. Japanese patent 63-137096 discloses a floating boat lift with four air filled pontoons.

None of the above inventions and patents, taken either singly or in combination, is seen to describe the instant invention as claimed.

SUMMARY OF THE INVENTION

The present invention is a floating dry dock for boats. The dry dock has two side pontoons and a front pontoon. The pontoons have rectangular frames formed from 2 inch by 12 inch wood boards. Each pontoon has one or more plastic tubs filled with styrofoam batts and attached to the frame for flotation. The top of the pontoons are provided with 2 inch by 6 inch by 27 inch cedar wood decking. The two side pontoons are attached to each other using at least two metal cradles. The cradles are formed of three or five, (depending on size), sections of square steel tubing. Two of the sections are vertical posts attached to the outside of the pontoons by 10 inch by 10 inch square galvanized plates. Larger sizes of the dock include two vertical posts attached to the inside of the pontoons also using 10 inch by 10 inch square galvanized plates. The vertical posts are welded to a horizontal section of the cradle that includes a centered extension tube for increasing the overall width of the dock. The front pontoon is replaced with a longer pontoon when increasing the width, (if a front dock area is desired). The outside vertical posts of the front and rear cradles have wheels mounted thereon to allow the dock to be moved from one location to another, over dry land. By varying the length of the pontoons, (and number of cradles), and the number of plastic floatation tubs, the dock can be built and/or adjusted to be used with personal water craft lifts, (1,200 lb capacity), to large boat lifts, (6,800 lb and greater capacity). While the present invention is designed primarily to be used with Harbor Master Boat Lifts, the adjustable nature of the dry dock makes it usable with a large number of boat lifts by other manufacturers.

One of the major advantages of the above design is the fact that the center of gravity of the floating dry dock is 24"–30" below the water line. The more weight placed on the dock, the more stable it becomes. This is because the portion of the dock below the water line acts as a sea anchor. Furthermore, the steel in the cradles acts as a torsion bar system, so that as one side of the dock descends, the other side is pulled down equally, keeping the dock level. Two pilings, a bottom anchored dock, or four anchors can be used to keep the floating dry dock stationary. A gang plank can be used for access, when the dry dock is close to another dock or shore.

Accordingly, it is a principal object of the invention to provide a floating dry dock that can be easily adjusted for use with a large selection of different size boats and boat lifts.

It is another object of the invention to provide a floating dry dock that is attractive as well as structurally sound.

It is a further object of the invention to provide a floating dry dock that can be easily and economically manufactured.

Still another object of the invention is to provide a floating dry dock that is easily moved from one location to the next.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
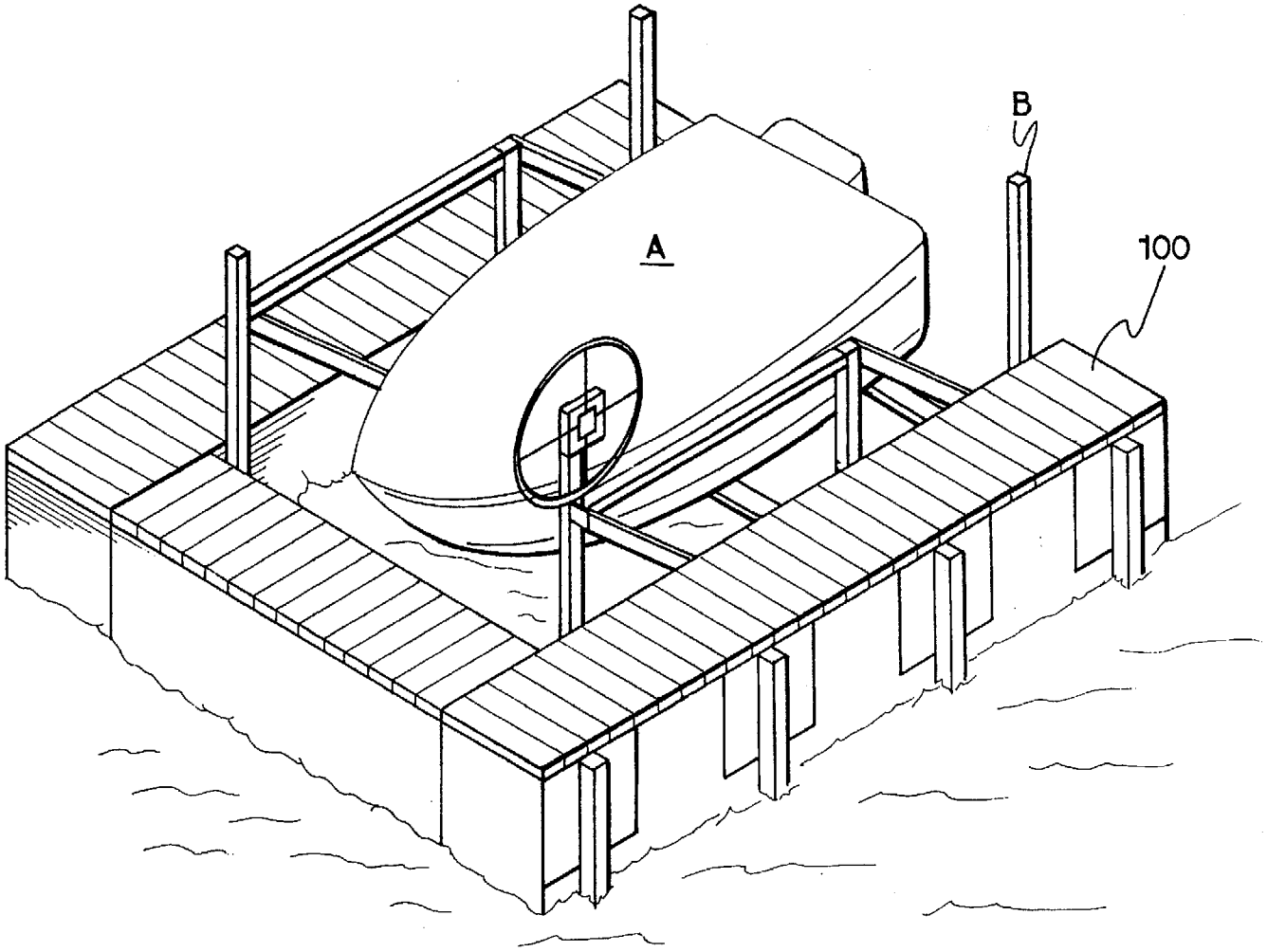
FIG. 1 is an environmental view of the dry dock in a floating position, and having a lift mechanism and boat mounted on the dock, the boat being raised out of the water.
Figure 2:
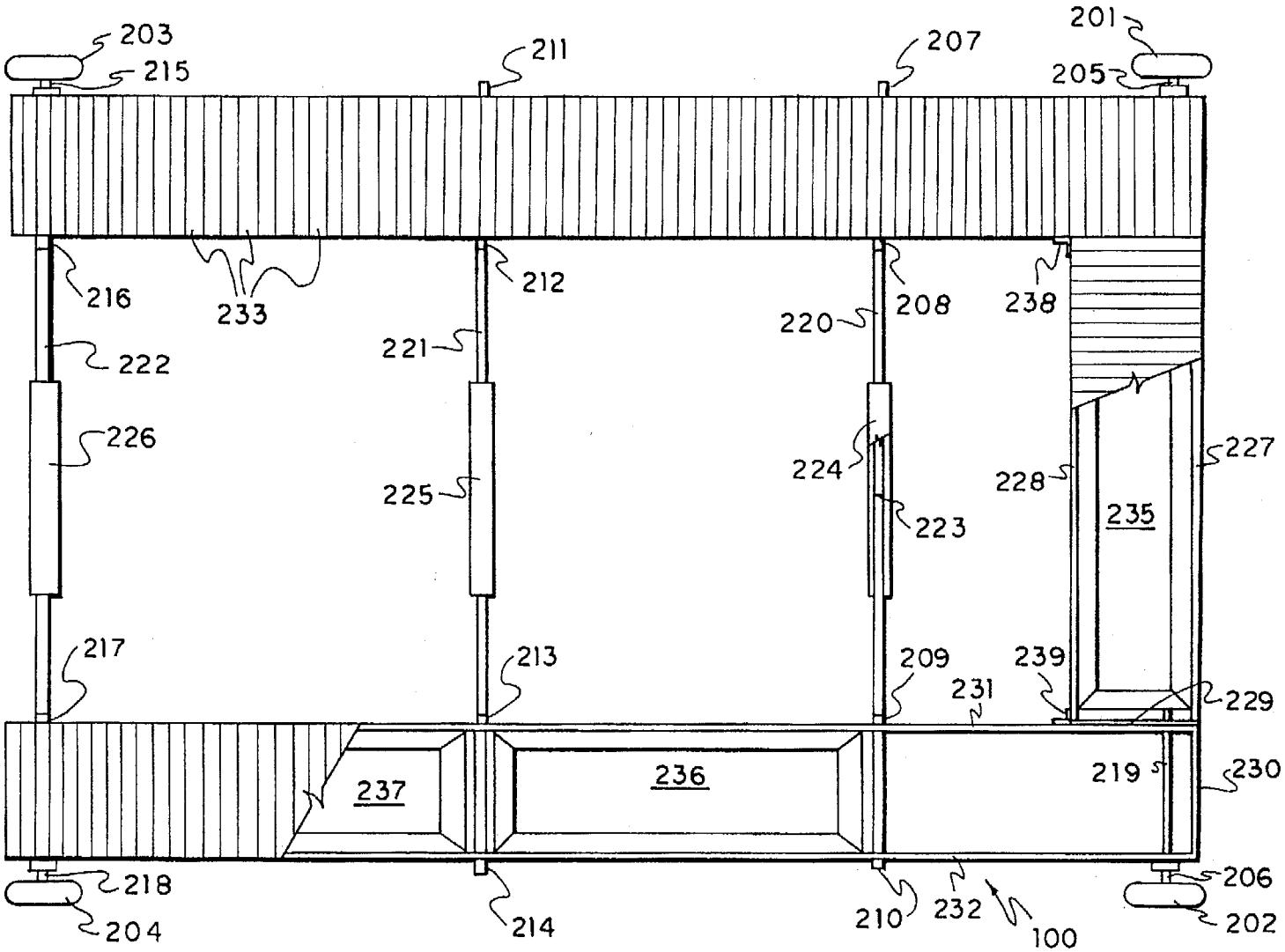
FIG. 2 is a top view of the floating dry dock.

The present invention is a floating dry dock for watercraft. As shown in FIG. 1, the floating dock 100 supports a boat lift B, which in turn supports a watercraft A. When the lift is in a lowered position, the dry dock supports the lift at a level that allows the watercraft to be driven on or off of the lift. After placing the watercraft on the lift, the lift can be raised using wheel 313 as shown in FIG. 3, and the dry dock supports the lift and watercraft at a level that keeps the entire watercraft out of the water.

Figure 3:
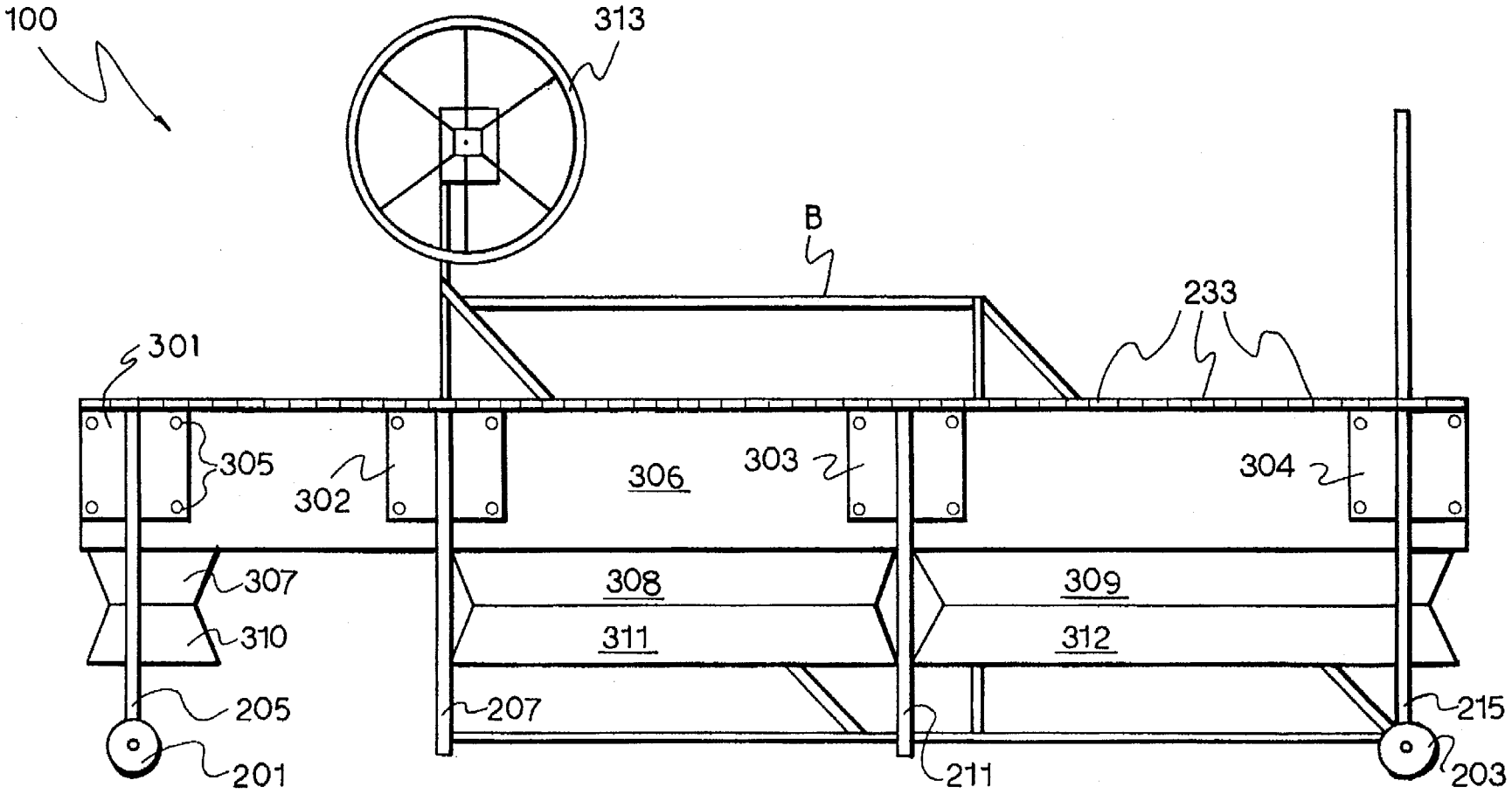
FIG. 3 is an elevational left side view of the floating dry dock, having the lift mechanism mounted thereon.
Figure 4:
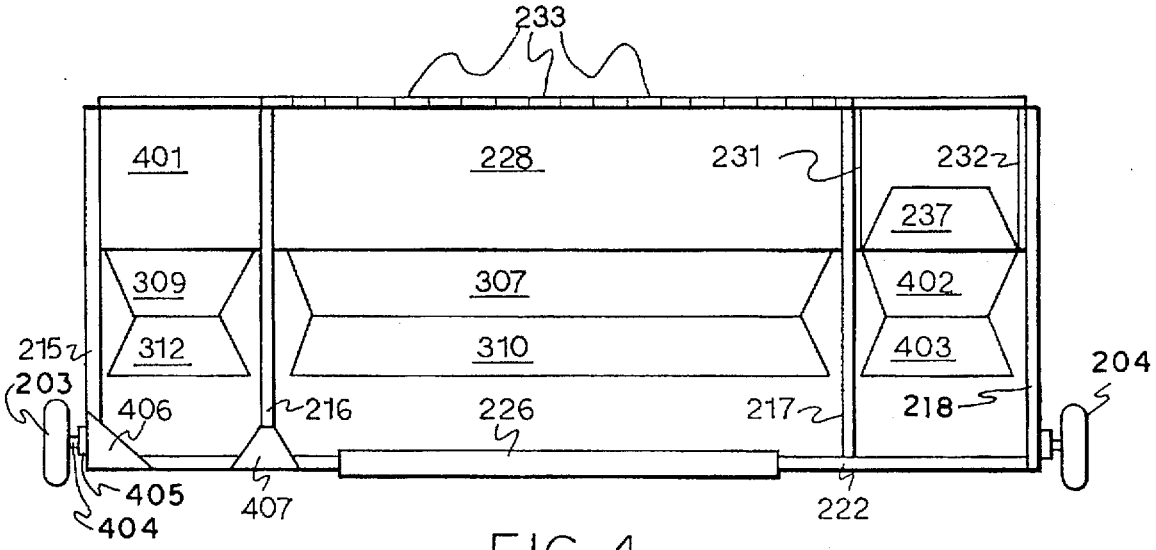
FIG. 4 is a rear view of the floating dry dock.
Figure 5:
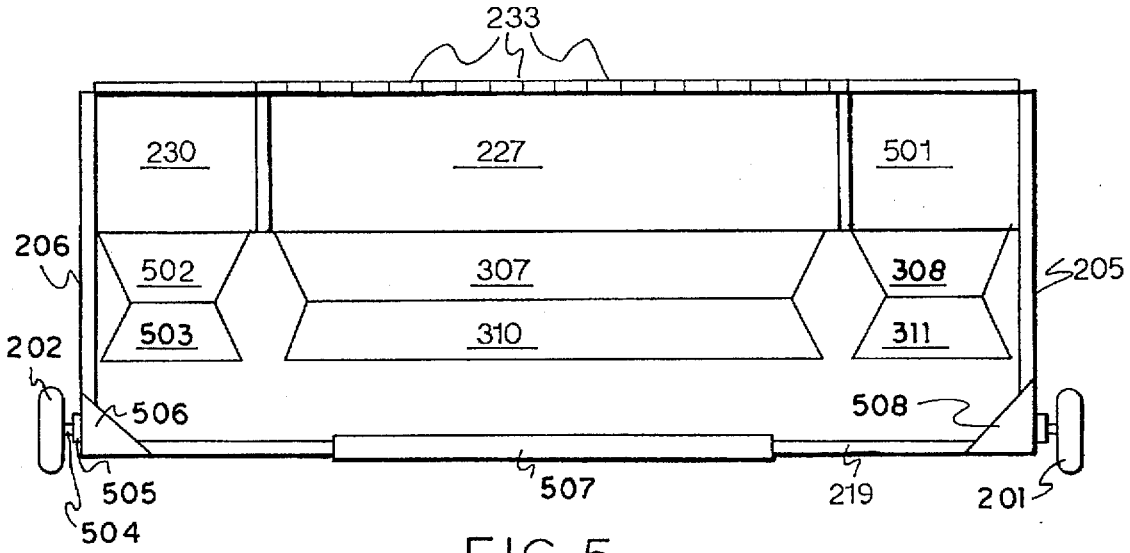
FIG. 5 is a front view of the floating dry dock.

Details of the floating dry dock can be seen in FIGS. 2–5, which show all the necessary elements for the largest version of the floating dry dock. The two side pontoons are mirror images of each other, and each is constructed using four pieces of 2 inch by 12 inch wood stock. Two side boards 231 and 232 are cut to an appropriate length for the size of the dry dock required. For personal watercraft, (wave runners, jet skis, etc.), the side boards are approximately eight feet long, and for larger watercraft the side boards can be 20 feet and longer. After the side boards are cut to an appropriate length, end boards (230, 401 and 501) are attached to the side boards using stainless steel or galvanized screws. It should be noted that the right rear end board has been omitted from FIG. 4, to show the interior of the right pontoon. The interior of each side pontoon includes two flotation units, shown on the right as 236 and 237. The flotation units are plastic tubs having styrofoam batts, (not shown), therein. The tubs have ¼" holes drilled therein for allowing water to enter and leave the tub as the water level changes due to differences in weight, (from loading or unloading a boat, people stepping onto and off the dock, etc.). The styrofoam batts are in solid form and cannot escape from the tubs, thereby reducing the impact on the environment. Each of the pontoons may be equipped with additional flotation units 308, 309, 311, 312, 402, 403, 502 and 503 mounted directly below the top two. The front pontoon has two side boards 227 and 228 that are cut to a length appropriate for the desired width of the dry dock. After being cut, the side boards are attached to two end boards 229 using stainless steel or galvanized bolts. The interior of the front pontoon contains a single flotation unit 235, however, as in the side pontoons, additional flotation units may be mounted directly below the top pontoon, (as shown in FIGS. 3–5, as 307 and 310). Once the width of the dry dock has been determined, and the front pontoon has been sized accordingly, the front pontoon is attached to the side pontoons using galvanized or stainless steel brackets 238 and 239, as well as brackets on the front of the dry dock, (not shown).

The top of the pontoon units are all provided with 2"×6"×27" cedar decking boards 233 that are screwed to the side boards of the pontoon units using stainless steel or galvanized wood screws.

The side pontoons are attached to each other using at least two cradles. The cradles support an appropriately sized boat lift B, and include horizontal members 220, 221 and 222. Each horizontal member is separated at the center by a transverse cut 223 that allows adjustment of the width of the dry dock. Center tubes 224–226, hold both halves of the horizontal members together. In addition to the cradles, a front support member 219 is also provided to hold the side pontoons together, and is extendable in the same manner as the cradles using center tube 507. The front support member is provided with vertical members 205 and 206 for attachment to the side pontoons. The cradles are also provided with vertical members 207–218 for attachment to the side pontoons. Each of the vertical members is welded to a 10"×10" steel plate, (as shown in FIG. 3 as 301–304), and the steel plates connected by ⅜" galvanized or stainless steel hex head bolts 305 to the outside side boards, 232 and 306, of the side pontoons. As is best seen in FIG. 4, each of the cradle assemblies include four vertical members and a horizontal member. The vertical and horizontal members are welded to each other using brackets 406 and 407, (note that the brackets have been omitted from the left side of the drawing to show the detail of the connections). FIG. 5 shows the details of the front support member. The front support member includes two vertical members and a horizontal member that are welded to each other using brackets 506 and 508. The rearmost cradle and the front support member have wheels 201–204 mounted to the outermost vertical members thereof. As shown in FIGS. 4 and 5, axles 404 and 504 are mounted to the vertical members using brackets 405 and 505.

While the above description is intended to give a general overview of the floating dry dock of the present invention, the following alternate embodiments should be noted.

When the dry dock is used for boat lifts for personal water craft (PWC), the side pontoons are 12 feet long, and the side boards are 2"×10" as opposed to the 2"×12" boards used below. Two cradles are provided, and by using the center tubes the cradles are adjustable between 54"–108". The vertical and horizontal members are 1" square galvanized steel tubing. The double PWC lift is 12 feet long and 162" wide, with a 2,500 lb weight capacity to allow two PWCs to be mounted thereon.

A second embodiment of the floating dry dock is 20 feet long, and has three cradles. The cradles are adjustable from 96"–120". The vertical and horizontal members are 2" square galvanized steel tubing. This embodiment is 20 feet long by 13.5 feet wide and will carry a total weight of 4,500 lbs.

A third embodiment of the floating dry dock is 20 feet long, has three cradles and is 20 feet wide. The total weight capacity is 6,800 lbs.

In addition to the above embodiments, larger versions can also be constructed. For versions over 20 feet long, the side boards of the pontoon units would be replaced by metal I-beams, and the tubs and decking would be directly attached to these I-beams.

All of the lumber used in the floating dry dock is pressure treated, and can be stained or painted to suit the tastes of the user. The metal used for the cradles and the front support member is galvanized steel, but aluminum or stainless steel may also be used depending on strength and weight requirements. The hardware, (wood screws, nuts and bolts), are galvanized steel or stainless steel. The use of these materials makes the floating dry dock ideal for both fresh water as well as salt water applications. Additionally, a canopy can be mounted on top of the floating dry dock to protect the dock, lift system, and boat from the elements.

It is to be understood that the present invention is not limited to the sole embodiment described above, but encompasses any and all embodiments within the scope of the following claims.

I claim:

1. A floating dry dock for supporting a boat lift and a boat, said dry dock comprising:

two side pontoons, each pontoon having two side boards, two end boards and two flotation units; and at least two cradles connecting the side pontoons to each other, each cradle having four vertical members and a horizontal member;

said horizontal member having a center cut and a center tube to allow adjustment of an overall width of said dry dock.

2. The floating dry dock according to claim 1, wherein each flotation unit comprises at least one plastic tub.

3. The floating dry dock according to claim 2, wherein each flotation unit comprises at least two plastic tubs, said tubs being vertically stacked.

4. The floating dry dock according to claim 3, wherein each flotation unit comprises three plastic tubs, said tubs being vertically stacked.

5. The floating dry dock according to claim 1, further comprising a front pontoon, said front pontoon having two side boards, two end boards and a front flotation unit.

6. The floating dry dock according to claim 5, wherein each flotation unit comprises at least one plastic tub.

7. The floating dry dock according to claim 6, wherein each flotation unit comprises at least two plastic tubs, said tubs being vertically stacked.

8. The floating dry dock according to claim 7, wherein each flotation unit comprises three plastic tubs, said tubs being vertically stacked.

9. The floating dry dock according to claim 5, wherein said pontoons have decking boards fastened to the side boards thereof.

10. The floating dry dock according to claim 1, further comprising a front support member, said front support member having two front vertical members and a front horizontal member, said front horizontal member having a center cut and a center tube to allow adjustment of said overall width of said dry dock.

11. The floating dry dock according to claim 10, wherein said front vertical members and an outermost pair of said vertical members on a rearmost of said at least two cradles all have a bracket mounted thereto, said brackets each supporting an axle that supports a wheel, to allow transport of said dry dock over land.

12. The floating dry dock according to claim 1, wherein said pontoons have decking boards fastened to the side boards thereof.

13. The floating dry dock according to claim 1, wherein said at least two cradles are comprised of three cradles.

14. The floating dry dock according to claim 1, wherein said vertical members include attachment means for attaching said vertical members to said side boards of said side pontoons.

15. A combination comprising a boat lift and a floating dry dock for supporting said boat lift, said dry dock comprising:

two side pontoons, each pontoon having two side boards, two end boards and two flotation units; and at least two cradles connecting the side pontoons to each other, each cradle having four vertical members and a horizontal member;

said horizontal member having a center cut and a center tube to allow adjustment of an overall width of said dry dock to accommodate different sizes of said boat lift;

said boat lift being supported vertically by resting on said horizontal members of said at least two cradles.

16. The combination according to claim 15, wherein said at least two cradles are comprised of three cradles.

* * * * *